US009884698B2

(12) United States Patent
Boukobza

(10) Patent No.: US 9,884,698 B2
(45) Date of Patent: Feb. 6, 2018

(54) THERMOPLASTIC CONTAINER IN PARTICULAR A BOTTLE HAVING A PARTIALLY PRISMATIC TRIANGULAR BODY

(75) Inventor: Michel Boukobza, Octeville-sur-Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 918 days.

(21) Appl. No.: 13/527,707

(22) Filed: Jun. 20, 2012

(65) Prior Publication Data

US 2012/0261430 A1 Oct. 18, 2012

Related U.S. Application Data

(62) Division of application No. 12/482,887, filed on Jun. 11, 2009, now abandoned.

(30) Foreign Application Priority Data

Jun. 17, 2008 (FR) ..... 08 53979

(51) Int. Cl.
*B65D 1/06* (2006.01)
*B65D 1/02* (2006.01)

(52) U.S. Cl.
CPC .... *B65D 1/0223* (2013.01); *B65D 2501/0081* (2013.01)

(58) Field of Classification Search
CPC ..... B65D 1/0223; B65D 1/023; B65D 1/0261
USPC ..... 215/381–384; 220/669, 673
See application file for complete search history.

(56) References Cited

U.S. PATENT DOCUMENTS

| | | | |
|---|---|---|---|
| D49,730 | S | 10/1916 | Graham |
| D59,106 | S | 9/1921 | Hothersall |
| D64,127 | S | 3/1924 | Miller |
| 1,636,174 | A | 7/1927 | Dolan et al. |
| D189,372 | S | 11/1960 | Adell |

(Continued)

FOREIGN PATENT DOCUMENTS

| | | |
|---|---|---|
| EP | 1 908 693 A1 | 4/2008 |
| FR | 2 906 224 A1 | 3/2008 |

(Continued)

OTHER PUBLICATIONS

Chinese Office Action dated Jul. 21, 2010 issued in corresponding Chinese Application No. 200910150445.7.

(Continued)

*Primary Examiner* — Ernesto Grano
(74) *Attorney, Agent, or Firm* — Sughrue Mion, PLLC

(57) ABSTRACT

Thermoplastic container (1) which after filling and sealing is able to withstand without any substantial deformation to an internal pressure lower than atmospheric pressure, comprising a body (2) with substantially cylindrical upper (3) and lower (4) parts and an intermediate part (5) having a curvilinear triangular cross section and comprising three main faces (6*a*, 6*b*, 6*c*) joined by three edges (7*a*, 7*b*, 7*c*); these edges are rounded, having continuous curvature, joined tangentially to the main faces and have radii of curvature (ra, rb, rc) comprised between approximately 5% and 35% of the largest dimension (D) of the cross section of the lower part (3); the main faces have radii of curvature (Ra, Rb, Rc) greater than the largest dimension (D) of the cross section of the lower part (3).

9 Claims, 4 Drawing Sheets

(56) References Cited

U.S. PATENT DOCUMENTS

| | | | | |
|---|---|---|---|---|
| 3,536,500 | A | 10/1970 | Cleereman et al. | |
| 3,702,806 | A | 11/1972 | Oliva | |
| 3,923,178 | A | 12/1975 | Welker | |
| 4,380,526 | A | 4/1983 | Agrawal | |
| 4,497,855 | A | 2/1985 | Agrawal et al. | |
| 4,946,053 | A | 8/1990 | Conrad | |
| 5,117,993 | A | 6/1992 | Vesborg | |
| 5,133,469 | A | 7/1992 | Mehta et al. | |
| D387,278 | S * | 12/1997 | Olivares | D9/541 |
| 5,746,260 | A | 5/1998 | Vesborg | |
| D396,244 | S | 7/1998 | Venne et al. | |
| 5,866,419 | A | 2/1999 | Meder | |
| 6,095,705 | A | 8/2000 | Phillips | |
| 6,213,337 | B1 | 4/2001 | Kamperman et al. | |
| D455,782 | S | 4/2002 | Singh et al. | |
| D467,183 | S | 12/2002 | Chew | |
| D468,646 | S * | 1/2003 | Joubert | D9/561 |
| D472,475 | S * | 4/2003 | Pinard | D9/574 |
| 6,637,613 | B2 | 10/2003 | Shimada et al. | |
| D481,954 | S * | 11/2003 | Potts et al. | D9/538 |
| 6,662,960 | B2 | 12/2003 | Hong et al. | |
| D489,271 | S | 5/2004 | Soomar | |
| 6,763,969 | B1 | 7/2004 | Melrose et al. | |
| 6,779,673 | B2 * | 8/2004 | Melrose et al. | 215/381 |
| D495,607 | S | 9/2004 | Bezek | |
| 6,913,405 | B2 | 7/2005 | Fischer et al. | |
| 6,923,334 | B2 | 8/2005 | Melrose et al. | |
| D511,102 | S * | 11/2005 | Trudeau | D9/544 |
| D511,300 | S * | 11/2005 | Hewson | D9/561 |
| 7,080,747 | B2 | 7/2006 | Lane et al. | |
| 7,172,087 | B1 | 2/2007 | Axe et al. | |
| 7,178,684 | B1 | 2/2007 | Budden et al. | |
| D543,116 | S | 5/2007 | Heisner | |
| 7,296,702 | B2 * | 11/2007 | Tanaka et al. | 215/383 |
| D557,609 | S | 12/2007 | Ungrady et al. | |
| D579,780 | S | 11/2008 | Lepoitevin | |
| 7,458,478 | B2 | 12/2008 | Kamineni | |
| 7,581,654 | B2 | 9/2009 | Stowitts | |
| D616,306 | S * | 5/2010 | Coury | D9/529 |
| D622,153 | S * | 8/2010 | Smith | D9/561 |
| 7,798,350 | B2 | 9/2010 | Hermel et al. | |
| 7,810,664 | B2 | 10/2010 | Trude | |
| 7,815,064 | B2 | 10/2010 | Howell et al. | |
| 8,186,528 | B2 | 5/2012 | Melrose et al. | |
| 8,087,525 | B2 | 6/2012 | Kelley et al. | |
| 8,567,625 | B2 | 10/2013 | Nemoto | |
| D751,415 | S * | 3/2016 | Otani | D9/686 |
| 2002/0104820 | A1 | 8/2002 | Hong et al. | |
| 2003/0015491 | A1 | 1/2003 | Melrose et al. | |
| 2004/0045206 | A1 | 3/2004 | Witham | |
| 2004/0099673 | A1 * | 5/2004 | Burgassi | B65D 1/0223 220/669 |
| 2004/0129598 | A1 | 7/2004 | Zhang et al. | |
| 2004/0200799 | A1 * | 10/2004 | Yourist et al. | 215/381 |
| 2005/0031398 | A1 | 2/2005 | Fischer et al. | |
| 2005/0067369 | A1 | 3/2005 | Trude | |
| 2005/0084316 | A1 | 4/2005 | Bradley et al. | |
| 2005/0150859 | A1 | 7/2005 | Lane et al. | |
| 2007/0007234 | A1 | 1/2007 | Tanaka et al. | |
| 2007/0090083 | A1 | 4/2007 | Trude | |
| 2007/0125743 | A1 * | 6/2007 | Pritchett et al. | 215/379 |
| 2007/0257004 | A1 | 11/2007 | Howell et al. | |
| 2008/0041811 | A1 | 2/2008 | Stowitts | |
| 2008/0073315 | A1 | 3/2008 | Hermel et al. | |

FOREIGN PATENT DOCUMENTS

| | | | |
|---|---|---|---|
| WO | 2005/030590 | A2 | 4/2005 |
| WO | 2005/123517 | A1 | 12/2005 |

OTHER PUBLICATIONS

French Preliminary Search Report for FR 08 53979, dated Oct. 23, 2008.

United States Office Action dated Oct. 2, 2012 for related U.S. Appl. No. 12/482,887.

United States Office Action dated Feb. 7, 2012 for related U.S. Appl. No. 12/482,887.

Final Office Action dated Mar. 21, 2014 issued in corresponding U.S. Appl. No. 12/482,887.

United States Office Action dated Feb. 25, 2016 for U.S. Appl. No. 12/482,887.

* cited by examiner

THERMOPLASTIC CONTAINER IN PARTICULAR A BOTTLE HAVING A PARTIALLY PRISMATIC TRIANGULAR BODY

CROSS REFERENCE TO RELATED APPLICATION

This application is a Divisional Application of U.S. application Ser. No. 12/482,887 filed Jun. 11, 2009, which claims benefit of French Application 08/53979 filed Jun. 17, 2008. The entire disclosures of which are herein incorporated by reference.

FIELD OF THE INVENTION

The present invention relates in general terms to the field of containers made of a thermoplastic material, in particular PET, and more particularly to improvements made to containers of this type, in particular bottles, made of a thermoplastic material such as PET, which after filling and sealing are able to withstand without any substantial deformation to an internal pressure lower than atmospheric pressure, said container comprising a body having

- a substantially cylindrical lower part,
- a substantially cylindrical upper part, and
- an intermediate part, having a cross section of a general shape which is substantially triangular and curvilinear, inscribed within the respective contours of said lower and upper parts, and comprising three main faces joined by three edges.

BACKGROUND OF THE INVENTION

From document FR 2,906,224, a container as indicated above is known, which is arranged with each of the edges shaped in the form of a groove that opens outwards and comprises a bottom which has a reversed curvature with its convexity directed outwards. However, this arrangement reflects a concern for the purely mechanical reinforcement of the edges: for applications distributed in very large numbers, such as bottled water for example, the cost of containers must be reduced to a minimum, which means that each container has the thinnest possible walls even in the edge zones; if these walls become deformed, for example when the rounded faces of the body are subjected to a force directed radially inwards (particularly when the container is grasped in the hand), the edges "break", in other words they deform in an angular, inflexible manner and are unable to resume their original shape. But such an arrangement does not allow a container of this type to be produced, which after filling and sealing is able to withstand without any substantial deformation to an internal pressure lower than atmospheric pressure, in particular after filling with a hot liquid.

Admittedly, from document WO 2005/123517 a container is known the edges of which are in a projecting shape, each comprising a rounded wall portion flanked by two columns, in order to avoid any deformation of the edges when the container is filled with a hot liquid. However, the bulges thus formed between the rounded faces of the body do not give the container an aesthetically pleasing appearance.

It must also be noted, as regards the container known from document FR 2,906,224, that although the appearance can be considered aesthetically better than that of document WO 2005/123517, nevertheless the edge zones also have reliefs (in this case sunken) which are not always favourably received in practice.

Furthermore, for the two above-mentioned types of containers, the relatively complex shape of the body thus constituted, with its projecting or sunken reliefs in the edge zones, requires lengthy and therefore costly machining of the blow mould.

Finally, the presence of these reliefs in the edge zones makes affixing a label or similar more difficult and the latter less robust and more easily detached or torn.

SUMMARY OF THE INVENTION

The purpose of the invention is therefore to propose an improved arrangement for a container, in particular a bottle, made of thermoplastic material such as PET, which better satisfies requirements in practice while being able, after filling and sealing, to withstand without any substantial deformation to an internal pressure lower than atmospheric pressure, and this result being achieved by employing a simpler shape than those already known, and which also has an aesthetically improved appearance, at least with a view to certain applications, with the attendant simplification of the shape of the mould cavity and a reduction in manufacturing costs.

To this end, a container as mentioned in the preamble, being arranged according to the invention, is characterized:

in that the edges are rounded, with respective continuous curves, and are joined tangentially to the main faces, in that the edges have respective radii of curvature comprised between approximately 5% and 35% of the largest dimension of the cross section of said lower part of the body, and in that the main faces have respective radii of curvature greater than the largest dimension of the cross section of said lower part of the body.

When arranged in this way, a container according to the invention has an intermediate zone which satisfies the requirements detailed above in every respect. In particular, such a container is able to withstand without any substantial deformation to an internal pressure which is substantially lower than the external pressure, in particular than atmospheric pressure, a situation which occurs in particular when the container is filled with a hot liquid or which can also occur under certain storage conditions of the filled containers.

Furthermore, the body of the container has a smooth contour without any stepped section, sunken or projecting relief, even in its intermediate part which has a substantially triangular and curvilinear cross section, and a container shaped in this way, specifically intended for this particular application, has an analogy of general shape with a standard container, which was not the case for the containers of the prior art intended for the same purpose; this satisfies the requirements of at least one section of users.

Finally a smooth shape, such as the one proposed, facilitates affixing labels or similar and keeping them in position.

The provisions which have just been described can give rise to numerous embodiments. Thus, it can be provided for the radii of curvature of the three edges to be different; or for the radii of curvature of only two edges to be equal; or also for the radii of curvature of all three edges to be equal.

It can also be envisaged for said main faces to be substantially flat, or to be curved with a convexity directed outwards.

In a preferred embodiment, it is provided for said lower and upper parts of the body to have the same shape and the same transverse dimensions.

In particular, in a practical example, it can be provided for the lower and/or the upper part of the body to have a circular cross section, but an elliptical or oval cross section can also be envisaged.

In practice, the edges can have substantially straight axial extensions, or be inclined with respect to the axis of the body, or also have curvilinear axial extensions.

BRIEF DESCRIPTION OF THE DRAWINGS

The invention will be better understood on reading the following detailed description of certain preferred embodiments given by way of example only and in no way limitative. In this description, reference is made to the attached drawings, in which.

DETAILED DESCRIPTION OF THE INVENTION

Figure 1A:
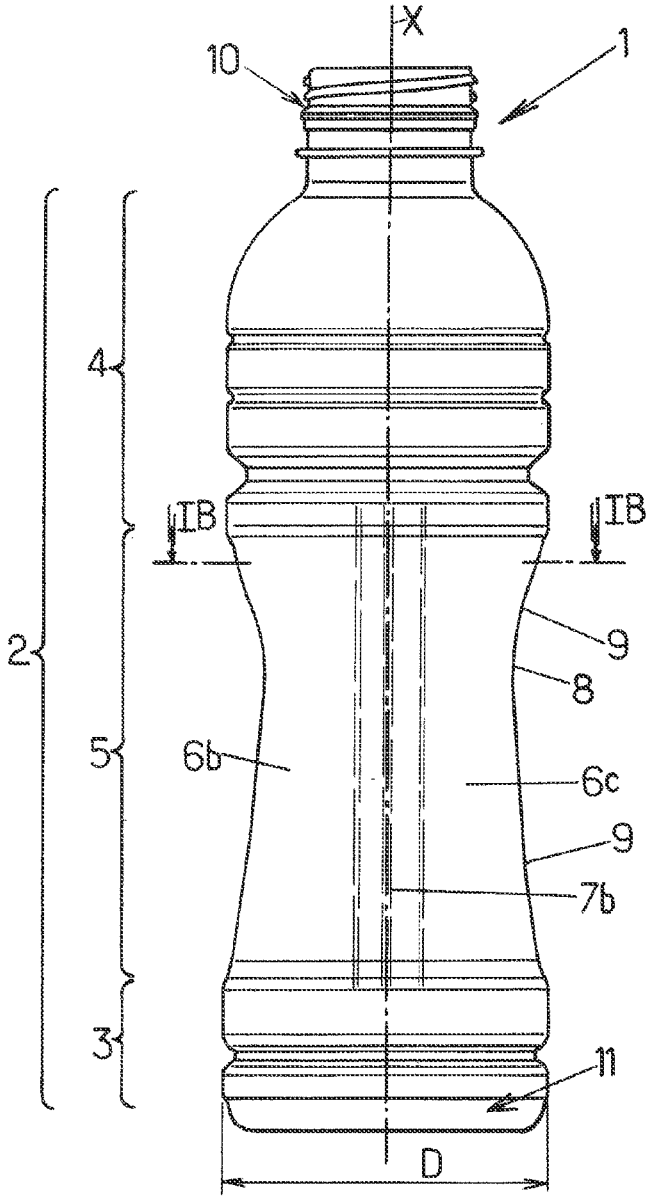
FIGS. 1A and 1B are very diagrammatic views, respectively a side view and a top view cut along the line IB-IB in FIG. 1A, of a container such as a bottle arranged according to the invention.
Figure 1B:
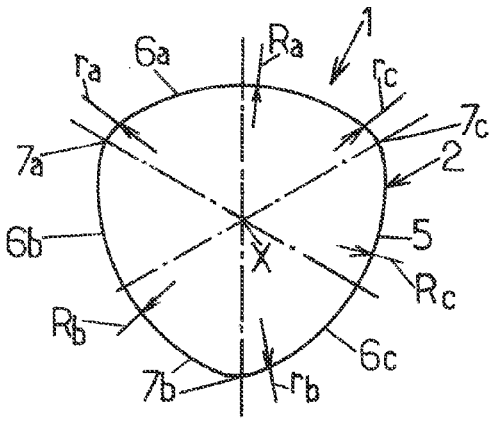

Reference will firstly be made to FIGS. 1A and 1B which show diagrammatically a container 1 such as a bottle made of thermoplastic material such as PET, which after filling and sealing is able to withstand without any substantial deformation to an internal pressure lower than atmospheric pressure.

The container 1 comprises a neck 10, a base or bottom 11 and a body 2 which extends between said neck and said base and has:

- a substantially cylindrical lower part 3,
- a substantially cylindrical upper part 4, and
- an intermediate part 5 which has (see FIG. 1B) an approximately prismatic triangular and curvilinear general shape, i.e. it has a cross section which is generally substantially triangular and curvilinear in shape inscribed within the respective contours of said lower part 3 and upper part 4, this intermediate part 5 comprising three main faces 6*a*, 6*b*, 6*c* joined by three edges 7*a*, 7*b*, 7*c*.

Figure 2A:
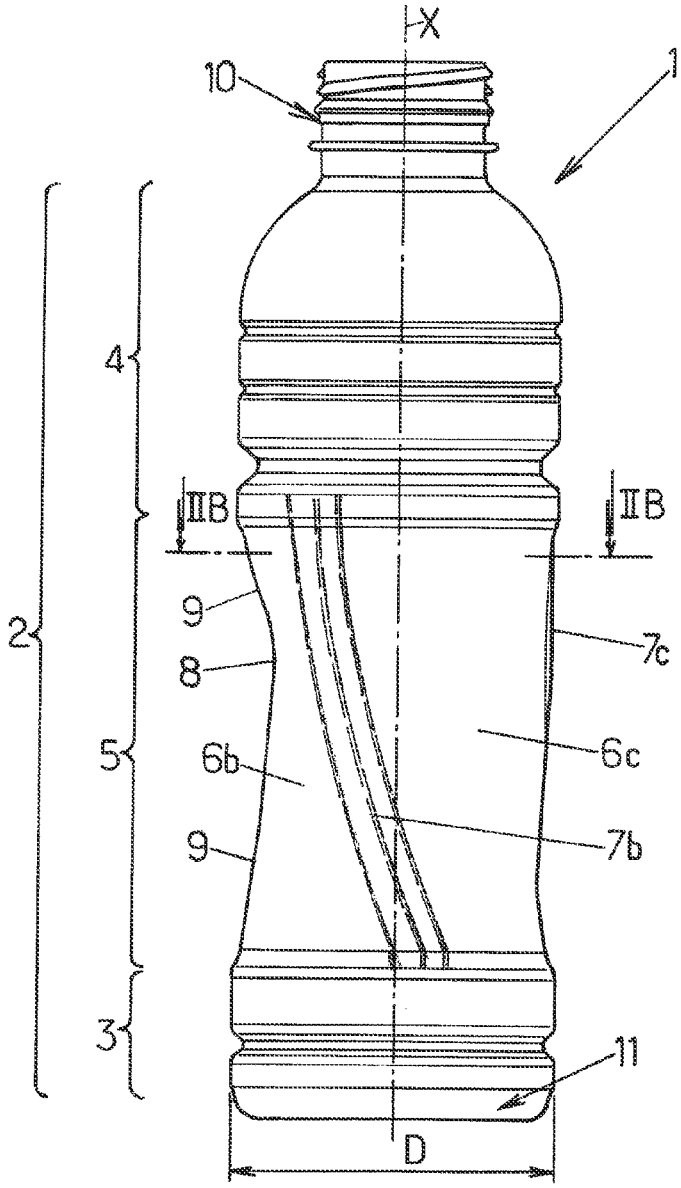
FIGS. 2A and 2B are very diagrammatic views, respectively a side view and a top view cut along the line IIB-IIB of FIG. 2A, of a variant of the container such as a bottle shown in FIGS. 1A and 1B.

In the following, reference will be made to the axis X of the container, a term by which is meant the axis passing through the centre of the neck 10 and the centre of the base 11 of said container 1, as can be seen in FIGS. 1A and 2A.

According to the invention, the edges 7*a*, 7*b*, 7*c* are rounded with respective continuous curves (the respective radii of curvature of the edges are ra, rb, rc) and join tangentially with the main faces 6*a*, 6*b*, 6*c* (the respective radii of curvature are Ra, Rb, Rc).

Furthermore, the edges 7*a*, 7*b*, 7*c* have respective radii of curvature ra, rb, rc which are comprised between approximately 5% and 35% of the largest dimension D of the cross section of the lower part 3 of the body 2.

Finally, the main faces 6*a*, 6*b*, 6*c* have radii of curvature Ra, Rb, Rc which are greater than the largest dimension D of the cross section of the lower part 3 of the body 2. If reference is made to the examples shown in FIGS. 3 and 4 respectively, it will be noted that the dimension D is the diameter of the lower part 3 of the body 2 which has a circular contour in the example of FIG. 3, while the dimension D is the major axis of the lower part 3 of the body 2 which has an oval contour in the example in FIG. 4.

The provisions which have just been described can give rise to numerous embodiments and thus to numerous embodiment variants.

Figure 2B:
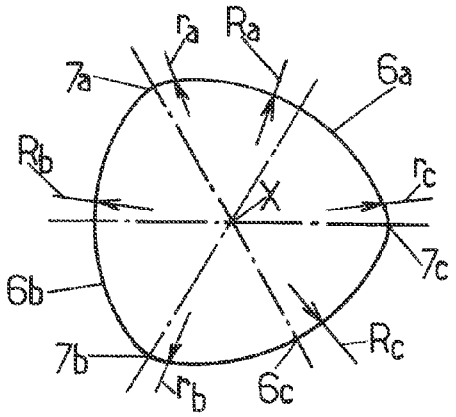
Figure 3:
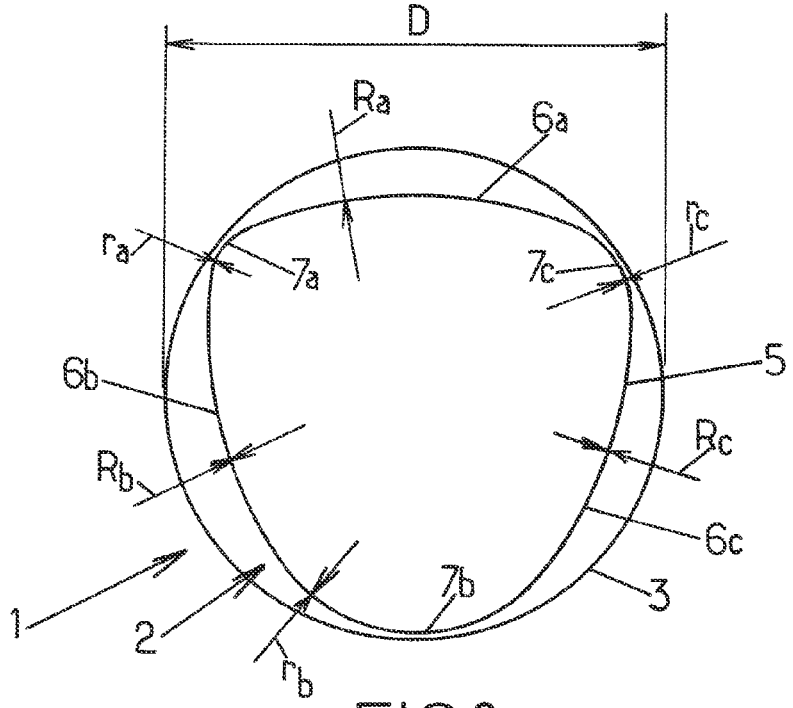
FIG. 3 is a bottom view diagram of an embodiment of a container such as a bottle arranged according to the invention.
Figure 4:
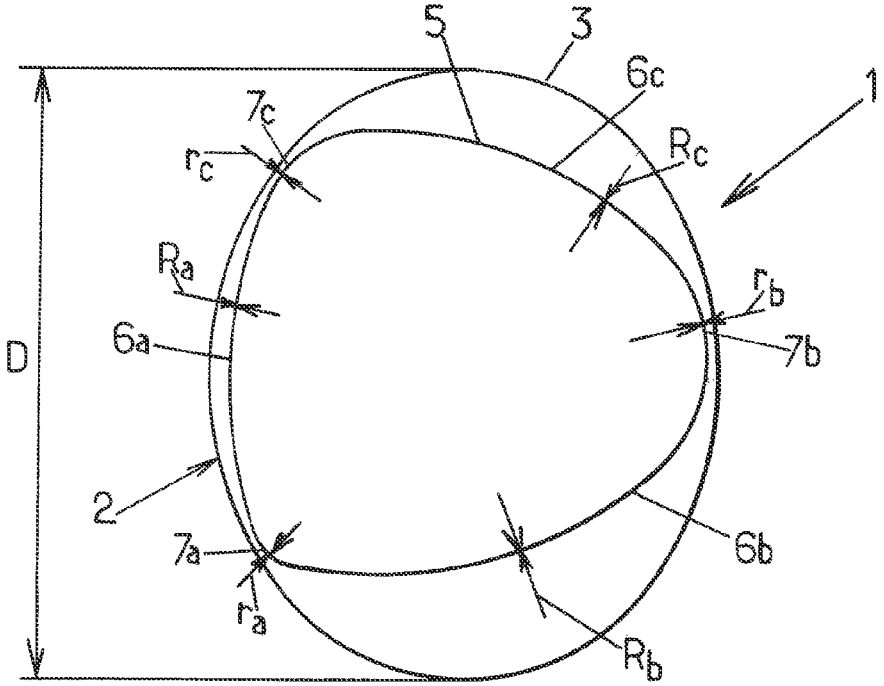
FIG. 4 is a bottom view diagram of another embodiment of a container such as a bottle arranged according to the invention.
Figure 5:
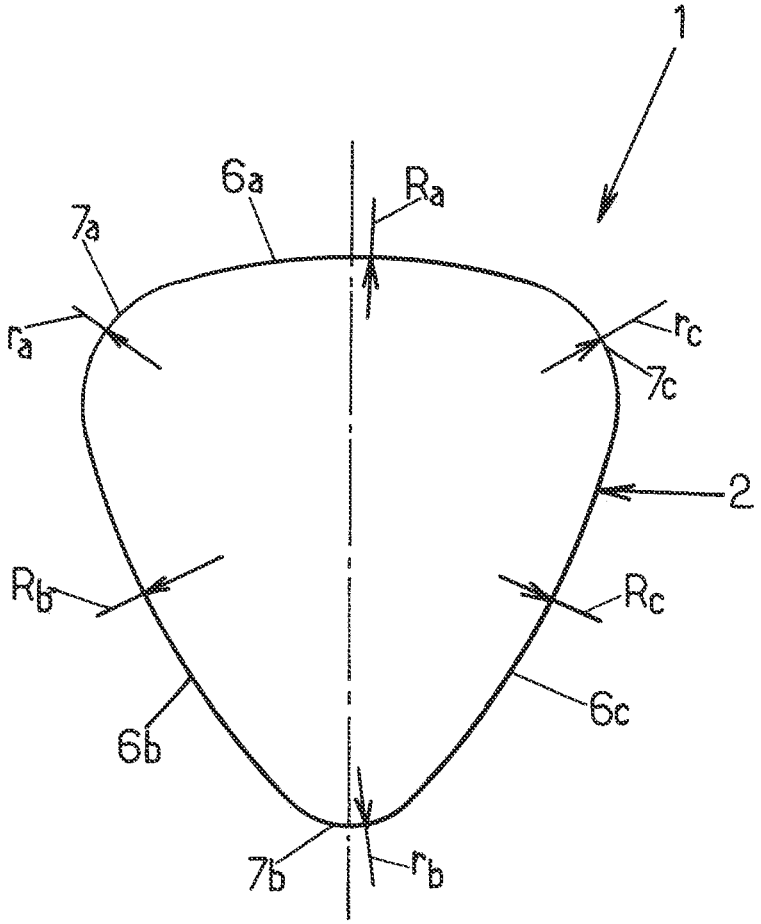
FIG. 5 is a diagrammatic top view section of yet another possible variant embodiment.

Thus as regards the radii of curvature ra, rb, rc of the three rounded edges 7*a*, 7*b*, 7*c*, they can equally well, according to need, all be different as shown in FIGS. 3 and 4 (the edge 7*b* has a large radius of curvature rb; the edge 7*a* has a small radius of curvature ra; the edge 7*c* has an intermediate radius of curvature rc comprised between the two previous ones), or even be equal for only two edges as shown in FIG. 5 (the two edges 7*a*, 7*c* have equal radii of curvature ra, rc, while the edge 7*b* has a different, smaller radius of curvature 7*b*), or also all three can be equal, as shown in FIGS. 1B and 2B.

In order to set down the idea, in a example referring to a bottle having a diameter of approximately 70 mm, the edges 7*a*, 7*b*, 7*c* have radii of curvature ra, rb, rc comprised between approximately 3.5 mm and 24.5 mm; specifically, the three edges are identical and have approximately the same radius of curvature of approximately 10 mm.

As regards the main faces 6*a*, 6*b*, 6*c*, they can have any shapes, optionally different from each other. Thus by way of example in FIGS. 1B and 2B the three main faces 6*a*, 6*b*, 6*c* are identical and have the same radius of curvature (Ra=Rb=Rc), while in FIG. 5 the two main faces 6*b* and 6*c* are identical and have the same radius of curvature (Rb=Rc) while the third main face 6*a* has a different radius of curvature Ra, and again, in FIGS. 3 and 4 the three main faces are different from each other with radii of curvature which are all different (Ra≠Rb≠Rc).

It is emphasised that the radii of curvature Ra, Rb, Rc can be any whatsoever: the main faces 6*a*, 6*b*, 6*c* can therefore be substantially flat, or be curved with a convexity directed outwards as illustrated in all the attached Figures, or a combination of these arrangements.

Also, as regards the overall shape of the body, all possibilities can be envisaged. In a preferred embodiment as shown in FIGS. 1A and 2A, the lower part 3 and upper part 4 of the body 2 have the same shape and the same transverse dimensions. In particular, as is common in practice, it can be provided for the lower part 3 and/or the upper part 4 of the body 2 to have a circular cross section as can be seen in the diagram of FIG. 3. But it is perfectly feasible, if necessary, for the lower part 3 and/or the upper part 4 of the body 2 to have any other shape, for example elliptical cross section, or also oval as shown in the diagram of FIG. 4.

The rounded edges 7*a*, 7*b*, 7*c* can have an axial extension with any suitable shape according to need. Thus FIG. 1A shows a shape consisting in that the edges 7*a*, 7*b*, 7*c* have axial extensions which are substantially straight and substantially parallel to the axis X of the container 1. However, such an arrangement is not exclusive and it is possible to provide for the edges 7*a*, 7*b*, 7*c* to be inclined with respect to the axis X of the body 2; they can also have axial curvilinear extensions; and of course these arrangements can be combined as illustrated in FIG. 2A which shows an edge 7*b* inclined with respect to the axis X of the body and curvilinear (curved).

Finally, it will be noted that, irrespective of the arrangement of their axial extensions, the main faces 6*a*, 6*b*, 6*c* can adapt to any shape of the body 2 of the container 1. Thus, the main faces 6*a*, 6*b*, 6*c* can be shaped such that the intermediate part 5 of the body has a substantially cylindrical shape with the wall of this intermediate part of the body extending substantially parallel to the axis X over the whole of its circumference. But the main faces 6*a*, 6*b*, 6*c* can also have an evolving axial profile with the transverse dimensions which axially vary. For example as illustrated on FIGS. 1A and 2A, in order to facilitate grasping the container, the main faces 6*a*, 6*b*, 6*c* can comprise a zone 8 which has reduced transverse dimensions, situated approximately at the level of the centre of gravity of the container when the latter is filled, the which zone 8 having reduced transverse dimensions is included between two flanking zones 9 having evolving transverse dimensions which gradually increase up to the dimensions of the lower part 3 and upper part 4 into which they merge.

What is claimed is:

1. A container made of thermoplastic material able after filling and sealing to withstand without any substantial deformation to an internal pressure lower than atmospheric pressure, said container comprising a body comprising:

a closed base and an open top;

a central axis extending between the closed base and open top;

a substantially cylindrical lower sidewall extending upwardly from said closed base, said substantially cylindrical lower sidewall having a lower cross section orthogonal to said central axis and defining a first diameter and a second diameter smaller than said first diameter;

a substantially cylindrical upper sidewall extending downwardly from said open top, said substantially cylindrical upper sidewall having an upper oval cross section orthogonal to said central axis; and a rounded triangular intermediate sidewall extending between said substantially cylindrical lower sidewall and said substantially cylindrical upper sidewall, said rounded triangular intermediate sidewall surrounding said central axis and having an intermediate cross section orthogonal to said central axis, said intermediate cross section defining three main curvilinear sides joined by three rounded edges that are inclined with respect to the central axis so that an area of the intermediate cross section varies along the central axis;

said three rounded edges have respective radii of curvature which are comprised between approximately 5% and 35% of the first diameter of said lower sidewall;

said three curvilinear sides have respective radii of curvature greater than the first diameter of said lower sidewall.

2. The container according to claim 1, wherein the radii of curvature of two rounded edges of the three rounded edges are equal.

3. The container according to claim 1, wherein said curvilinear sides are curved with a convexity directed outwards.

4. The container according to claim 1, wherein the container is a bottle.

5. The container according to claim 1, wherein the thermoplastic material is PET.

6. The container according to claim 1, wherein said edges have a curvilinear axial extension.

7. A container made of thermoplastic material able after filling and sealing to withstand without any substantial deformation to an internal pressure lower than atmospheric pressure, said container comprising a body comprising:

a closed base and an open top;

a central axis extending between the closed base and open top;

a substantially cylindrical lower sidewall extending upwardly from said closed base, said substantially cylindrical lower sidewall having a lower cross section orthogonal to said central axis and defining a first diameter and a second diameter smaller than said first diameter;

a substantially cylindrical upper sidewall extending downwardly from said open top, said substantially cylindrical upper sidewall having an upper oval cross section orthogonal to said central axis; and a rounded triangular intermediate sidewall extending between said substantially cylindrical lower sidewall and said substantially cylindrical upper sidewall, said rounded triangular intermediate sidewall surrounding said central axis and having an intermediate cross section orthogonal to said central axis, said intermediate cross section defining three main curvilinear sides joined by three rounded edges that are inclined with respect to the central axis so that an area of the intermediate cross section varies along the central axis;

said three rounded edges have respective radii of curvature which are comprised between approximately 5% and 35% of the first diameter of said lower sidewall;

said three curvilinear sides have respective radii of curvature greater than the first diameter of said lower sidewall, wherein said radii of curvature of said three rounded edges are all different.

8. A bottle made of thermoplastic material, and configured to, after filling and sealing, withstand, without any substantial deformation, an internal pressure lower than atmospheric pressure, said container comprising a body having:

a substantially cylindrical lower part, having an oval cross section defining a largest diameter of the lower part of the body, wherein the oval cross section extends through the lower part in a direction perpendicular to a longitudinally extending central axis of the body;

a substantially cylindrical upper part; and an intermediate part having a cross section of a substantially rounded triangular shape, said rounded triangular shape inscribed within respective contours of said lower and upper parts, said intermediate part comprising three main panels joined by three corner edges that are inclined with respect to the longitudinally extending central axis so that an area of the intermediate cross section varies along the longitudinally extending central axis, wherein said cross section of said intermediate part extends through the intermediate part in the direction perpendicular to the longitudinally extending central axis of the body;

said corner edges are rounded with respective continuous curves and are joined tangentially to said main panels;

each of said corner edges having a radius of curvature, which is between approximately 5% and 35% of said largest diameter of the cross section of said lower part of the body;

said main panels have respective radii of curvature greater than said largest diameter of the cross section of said lower part; and the cross section of the lower part of the body has an oval shape.

9. The bottle according to claim 8, wherein said edges have a curvilinear axial extension.

* * * * *